US009518546B2

(12) United States Patent
Hopley

(10) Patent No.: US 9,518,546 B2
(45) Date of Patent: Dec. 13, 2016

(54) PUMP ASSEMBLY

(75) Inventors: Daniel Jeremy Hopley, Chislehurst (GB); Joanne Hopley, legal representative, Chislehurst (GB)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 871 days.

(21) Appl. No.: 13/386,116

(22) PCT Filed: Jul. 19, 2010

(86) PCT No.: PCT/EP2010/060440

§ 371 (c)(1),
(2), (4) Date: May 4, 2012

(87) PCT Pub. No.: WO2011/009839

PCT Pub. Date: Jan. 27, 2011

(65) Prior Publication Data

US 2012/0255433 A1 Oct. 11, 2012

(30) Foreign Application Priority Data

Jul. 20, 2009 (EP) ..... 09165876

(51) Int. Cl.
*F15B 13/04* (2006.01)
*F02M 59/48* (2006.01)
(Continued)

(52) U.S. Cl.
CPC ..... *F02M 59/485* (2013.01); *F02M 39/00* (2013.01); *F02M 39/02* (2013.01); *F02M 59/464* (2013.01); *F02M 59/48* (2013.01); *F02M 59/06* (2013.01)

(58) Field of Classification Search
CPC .... F02M 59/485; F02M 59/464; F02M 39/00; F02M 39/02; F04B 1/0426; F04B 1/043; F04B 1/047; F04B 1/053; F04B 1/0531; F04B 1/0533; F04B 9/00; F04B 9/02; F04B 9/04; F04B 9/042
(Continued)

(56) References Cited

U.S. PATENT DOCUMENTS 6,205,980 B1 3/2001 Spinnler
6,554,590 B2 * 4/2003 Maeda et al. ..... 417/505
(Continued)

FOREIGN PATENT DOCUMENTS

DE 758837 6/1956
DE 10339278 1/2005
(Continued)

OTHER PUBLICATIONS

English Translation of First Japan Office Action dated Jul. 12, 2013.
International Search Report dated May 11, 2010.

*Primary Examiner* — Dominick L Plakkoottam
(74) *Attorney, Agent, or Firm* — Joshua M. James

(57) ABSTRACT

A pump assembly includes a pump housing provided with a bore within which a pumping plunger is reciprocal along a plunger axis; a pump chamber defined at one end of the bore within which fuel is pressurized to a relatively high level; and an inlet valve housed within the pump housing and in communication with the pump chamber to control the flow of fuel into the pump chamber. A clamp member applies a clamping load to the pump housing, which has at least a component that is aligned with the plunger axis, through a surface of the pump housing located approximately axially above the bore. The clamp member may be secured to the pump housing by a securing member, which may be positioned radially outwards from the bore and extend through or below a plane through the pump chamber and perpendicular to the plunger axis through the pump chamber.

19 Claims, 5 Drawing Sheets

(51) Int. Cl.

| | |
|---|---|
| ***F02M 39/00*** | (2006.01) |
| ***F02M 39/02*** | (2006.01) |
| ***F02M 59/46*** | (2006.01) |
| *F02M 59/06* | (2006.01) |

(58) Field of Classification Search
USPC ..... 417/470, 471, 490, 505; 91/164, 169.1, 91/171.1
See application file for complete search history.

(56) References Cited

U.S. PATENT DOCUMENTS

| | | | | |
|---|---|---|---|---|
| 7,114,928 | B2 | 10/2006 | Asayama et al. | |
| 7,287,967 | B2 * | 10/2007 | Asayama et al. | 417/63 |
| 2001/0043874 | A1 * | 11/2001 | Sano et al. | 417/440 |
| 2003/0103853 | A1 * | 6/2003 | Asayama et al. | 417/470 |
| 2003/0161746 | A1 * | 8/2003 | Asayama et al. | 417/470 |
| 2004/0052652 | A1 * | 3/2004 | Yamada et al. | 417/273 |
| 2006/0039811 | A1 * | 2/2006 | Nieslony et al. | 417/490 |
| 2007/0128058 | A1 * | 6/2007 | Kitamura | 417/437 |
| 2007/0215113 | A1 | 9/2007 | Dutt | |
| 2009/0126695 | A1 * | 5/2009 | Vu | 123/495 |
| 2010/0209274 | A1 * | 8/2010 | Oikawa et al. | 417/540 |

FOREIGN PATENT DOCUMENTS

| | | |
|---|---|---|
| EP | 0261102 | 3/1988 |
| EP | 1058001 | 12/2000 |
| EP | 1277950 | 1/2003 |
| GB | 1230152 | 4/1971 |
| GB | 2107801 | 5/1983 |
| JP | H2-1480 | 1/1990 |
| JP | 2001-295770 | 10/2001 |
| JP | 2006-207451 | 8/2006 |

* cited by examiner

PUMP ASSEMBLY

TECHNICAL FIELD

The invention relates to a pump assembly for an internal combustion engine. In particular, but not exclusively, the invention relates to a pump assembly for a common rail compression-ignition (diesel) internal combustion engine.

BACKGROUND TO THE INVENTION

FIG. 1 shows part of a known pump assembly for use in a common rail diesel engine. The pump assembly 10 includes a pump housing 12 provided with a blind bore 14 within which a pumping plunger (not shown) reciprocates, in use, under the influence of a drive arrangement (also not shown). The plunger and its bore extend co-axially through the pump housing 12 with the blind end of the bore defining a pump chamber 18 for fuel. Fuel at relatively low pressure is delivered to the pump chamber 18 through an inlet passage (not shown) under the control of an inlet non-return valve 20. Fuel is pressurised within the pump chamber 18 as the plunger reciprocates and, once it reaches a predetermined level, is delivered through an outlet valve in the pump housing (not shown) to an outlet passage which extends transversely to the bore 14. The outlet passage delivers pressurised fuel to a downstream common rail.

The pump housing 12 is provided with a cover 22 which is fixed to the pump housing by means of bolts (not shown). The cover 22 is of generally top-hat construction, having an annular skirt 22*a* which engages with an upper surface of the pump housing 12 and through which the bolts are located. By shaping the cover in this way and by locating the bolts through the annular skirt 22*a* around the periphery of the pump assembly, the overall profile of the pump assembly is more compact than in alternative arrangements in which a cover is mounted axially above the pump housing and bore. This arrangement thus has advantages in terms of space efficiency, which is of significant benefit in the crowded engine space. The remaining underside of the cover 22 and the upper surface of the pump housing 12 together define a volume 28 for receiving low pressure fuel which acts as a reservoir from which fuel is drawn through the inlet passage to the pump chamber 18 when the inlet valve 20 is open. The cover 22 also provides a protective feature for the pump assembly components.

Due to the high pressures that are generated within the pump chamber 18 during the pumping cycle, one problem that may occur within the pump assembly of the aforementioned type is high pressure fatigue of parts. As the plunger reciprocates within its bore 14 and fuel is pressurised to a high level within the pump chamber 18, a pulsating tensile stress occurs within the pump housing 12 that can cause cracks to grow. The pulsating tensile stress has two main effects within the pump housing 12: hoop stress acts around the perimeter of the plunger bore 14, particularly in the vicinity of the pump chamber 18, and axial stress acts along the length of the plunger bore 14. Therefore, it would be a benefit to have a pump assembly of the above-described type in which pulsating tensile stress and high pressure fatigue are reduced or eliminated.

GB2107801 describes another type of fuel injection pump, in which a pump housing is provided with a bore through which a piston reciprocates. A pump chamber is defined at one end of the piston bore, and two axial bores (one fuel inlet—for low pressure fuel, and one fuel outlet—for high pressure fuel) extend from the side of the pump chamber opposite the piston to the upper surface of the pump housing. A valve head (or block) is seated directly against the upper surface of the pump housing and secured in place with threaded screws so that a sealing engagement is formed between the pump housing and the valve head, which guards against fuel leakage between the two components. In this arrangement, the mounting of the valve head directly above the upper surface of the pump housing substantially counteracts any tensile stress caused by fuel pressure in the pump chamber. However, the inherent benefits in countering hoop and axial stress in this arrangement are at the cost of assembly size, in particular length (or axial height), which places additional packing constraints on the already crowded engine space. Also it is notable that in this arrangement the valve head contains an outlet valve member that is required to control the flow of high pressure fuel (possibly in excess of 2000 bar pressure). This configuration has the further disadvantage that the high pressure fuel generated in the pump chamber can potentially find a leakage path at the interface of the valve head (or block) and the pump housing. Fuel leakage is detrimental to pump performance and, therefore, it would be desirable to mitigate any risk of or actual fuel leak.

Thus, having regard to the prior art, it would be an advantage to have a fuel pump assembly of reduced size and of a convenient shape for engine packing requirements. It would further be beneficial to have a fuel pump assembly in which fuel leakage is reduced or minimised. It would also be desirable to have a fuel pump assembly in which axial stress and/or hoop stress is reduced or eliminated. Thus the present invention aims to reduce and/or solve one or more of the problems in the prior art.

SUMMARY OF THE INVENTION

The present invention relates broadly to a pump assembly of desirable shape and size (e.g. reduced size compared to the prior art and advantageous configuration to suit engine packing requirements), which reduces internal stress and fatigue of certain prior art apparatuses. More specifically the invention encompasses a clamping member for a pump assembly which exerts a compressive force on the assembly to counteract fuel-induced stress and fatigue in the pump assembly. The clamping member is shaped so as to exert a compressive force onto the pump assembly in a region that is approximately in axial alignment with the pump chamber and/or plunger bore, which is the source of the fuel-induced stress, and is adapted to be secured to the pump housing at a region that is not in axial alignment with the pump chamber and/or plunger bore. The present invention further relates to a pump assembly in which high pressure fuel leakage is reduced or eliminated by providing a high pressure fuel outlet valve housed within the pump head rather than in a separate valve block.

Thus, according to one aspect of the present invention, there is provided a pump assembly for use in an internal combustion engine, the pump assembly comprising: a pump housing provided with a bore within which a pumping plunger is reciprocal along a plunger axis, a pump chamber defined at one end of the bore within which fuel is pressurised to a relatively high level as the pumping plunger reciprocates within the bore, in use, and an inlet valve housed within the pump housing and in communication with the pump chamber to control the flow of fuel (at relatively low pressure) into the pump chamber; and a clamp member for applying a clamping load to the pump housing, the clamping load having at least a component aligned with the plunger axis, through a surface of the pump housing located approximately axially above the bore. In this way, the clamp member generates a compressive stress in the pump housing in close proximity to the plunger bore so as to counter tensile stress within the pump housing due to pressurised fuel within the pump chamber. By housing the inlet valve within the pump housing itself, it is not necessary to have a separate valve housing, which would add to the size of the pump assembly. In addition, it is not necessary to carefully machine two separate components so as to allow for a high-pressure seal between the pump housing and separate valve housing, which is important because the inlet valve must seal against high pressure fuel.

The inlet valve typically comprises a valve body and a valve head, such as a poppet-type valve. However, other valves types (e.g. a ball valve) may alternatively be used. The valve head may be of frustoconical or part-spherical form for sealing engagement with a seating surface of frustoconical or part-spherical form. Beneficially, the seating surface for the inlet valve is defined by a surface (e.g. an internal surface) of the pump housing. It will be appreciated that, in some embodiments, the entirety of the inlet valve may not be enclosed (or housed) within the pump housing, provided at least part of the inlet valve is housed within the pump housing such that a separate valve housing is not required. In this case it is sufficient that the valve head is substantially contained within the pump housing. In a preferred embodiment, the valve seat is defined by a surface of the pump chamber of the pump housing (i.e. at the intersection between the bore in which the inlet valve is located and the pump chamber. Conveniently, the inlet valve may be approximately in axial alignment with the plunger axis.

The clamp member is conveniently secured to the pump housing by way of at least one suitable securing member, as described elsewhere herein.

In another aspect there is provided a pump assembly for use in an internal combustion engine, the pump assembly comprising a pump housing provided with a bore within which a pumping plunger is reciprocal along a plunger axis, and a pump chamber defined at one end of the bore within which fuel is pressurised to a relatively high level as the pumping plunger reciprocates within the bore. A clamp member is provided for applying a clamping load to the pump housing, and at least one securing member is provided for securing the clamp member to the pump housing. The at least one securing member is located radially outwards from the bore (or from the plunger axis) and extends through or below a plane that is perpendicular to the plunger axis and passes through the pump chamber. The clamp member is arranged such that at least a component of the clamping load is aligned with the plunger axis, through an external surface of the pump housing located approximately axially above the bore so as to generate a compressive stress in the pump housing in close proximity to the plunger bore, to counter tensile stress within the pump housing due to pressurised fuel within the pump chamber. Suitably, the at least one securing member extends axially below the pumping chamber so as to overlap the plunger bore.

During the pumping cycle, a pulsating tensile stress is generated within the pump housing, particularly in close proximity to the plunger bore, due to the high pressures being generated within the pump chamber (typically pressures are in excess of 2000 bar for common rail fuel pump applications). By countering these tensile stresses with a compressive stress in the vicinity of the plunger bore, fatigue failure can be reduced or avoided. A further advantage of the invention is that by mounting the securing members radially outwards from the plunger axis the axial length of the pump assembly can be reduced. The clamping member is arranged so as to be able to exert a clamping load in the region approximately axially above the bore even when the securing members are mounted radially outwards from the bore.

In one embodiment of this or any other aspect of the invention, the pump housing includes a bore section within which the plunger bore is provided. The clamp member is arranged to apply the clamping load to the pump housing through a surface thereof which is located approximately axially above the bore section. Preferably, the bore extends into a head section of the pump housing so that the pump chamber is defined, at least in part, within the head section. The clamping load is therefore applied to that region of the pump housing containing the pump chamber and the plunger bore, where tensile stress is greatest. Typically, although not necessarily, the bore section may have a reduced diameter compared to the head section.

In one embodiment of this or any other aspect of the invention, the clamp member includes at least one contact surface (or a primary contact surface) for engagement with the external surface of the pump housing through which the clamping load is applied to the pump housing. The clamp member may, for example, include at least one projection on its internal (or lower) surface (i.e. internal to the pump assembly) to define the or each contact surface. Suitably, the clamp member has at least one primary contact surface that engages the pump housing approximately axially above the bore, and at least one secondary contact surface that engages the pump housing radially outwards from the bore. Beneficially for packing and space considerations, the clamp member may be top-hat shaped with a raised central region and a peripheral skirt (or one or more radially-extending flanges). In this arrangement, the primary contact surface is associated with the raised central region of the clamping member and the secondary contact surface is associated with the skirt (or flanges). In one embodiment, the secondary contact surface engages an external surface of the pump housing at an axial height relative to the plunger axis that is approximately overlapping with or below the pump chamber. In one embodiment the surface of contact (or seat) is below the axial position of the pump chamber, i.e. so that it overlaps the plunger bore.

The external surface of the pump housing and the internal surface of the clamp member may together define a filling chamber for receiving low pressure fuel, in use, from where fuel is delivered to the pump chamber.

In this embodiment, at least one filling port opens at the external surface of the pump housing to communicate with the filling chamber. The clamp member is preferably provided with at least two projections, each of which defines a contact surface for engagement with the pump housing at a position between adjacent filling ports. In this and other embodiments, the contact surfaces may preferably have an arc-formation.

The clamping load along the plunger axis may be generated in a number of ways that fall within the scope of the invention. In one embodiment, a spring is located between the internal surface of the clamp member and the external surface of the pump housing so that the clamping load is applied to the pump housing through the spring.

In another embodiment, the clamp member is formed from a material that deforms elastically as the clamping load is applied to the pump housing. Typically, the clamp member is formed from a material having a yield stress of between 1000 and 1800 MPa. In this case the clamp member effectively behaves as the spring in the above-mentioned embodiment.

In a still further embodiment, the clamp member is formed from a material that deforms plastically as the clamping load is applied to the pump housing. In this case, the clamp member is typically formed from a material having a yield stress of between 200 and 600 MPa.

The benefit of using a material that deforms plastically as the clamping load is applied to the pump housing is that any variations in the geometry of the clamp member have a less significant effect on the applied clamping load, and hence the induced compressive stress. As a result, pump-to-pump variations can be advantageously reduced, and the compressive stress induced within the pump housing, to counter the tensile stress caused by high-pressure fuel within the pump chamber, can be set more accurately.

It is preferable for at least one securing member (e.g. a bolt) to extend through the clamp member and the pump housing to secure the clamp member to the pump housing at an outer peripheral region of the pump housing.

In a third aspect, there is provided a pump assembly for use in an internal combustion engine, the pump assembly comprising: a pump housing provided with a bore within which a pumping plunger is reciprocal along a plunger axis; a pump chamber defined at one end of the bore within which fuel is pressurised to a relatively high level as the pumping plunger reciprocates within the bore, in use; and a clamp member for applying a clamping load to the pump housing, the clamping load having at least a component that is aligned with the plunger axis, through a surface of the pump housing located approximately axially above the bore so as to generate a compressive stress in the pump housing in close proximity to the plunger bore to counter tensile stress within the pump housing due to pressurised fuel within the pump chamber; wherein the clamp member is formed from a material that deforms as the clamping load is applied to the pump housing.

In this third aspect, the clamp member, the pump housing and any other feature may be defined as for the first and second aspects above.

In the second and third aspects, an inlet valve may be provided to control the flow of fuel into the pump chamber. Advantageously, the inlet valve is housed (or at least partially housed) within the pump housing, such that a separate valve housing is not required. The inlet valve and its housing may be as defined in accordance with the first aspect.

In any aspect of the invention, the pump assembly may further comprise an outlet valve in communication with the pump chamber to modulate the delivery of fuel (at relatively high pressure) from the pump chamber to an outlet passage. Advantageously the outlet valve is housed within the pump housing rather than a separate valve housing, which avoids the need for a separate housing member. The outlet valve may be of any suitable type, such as a ball-valve. Suitably, the seating surface for the outlet valve is defined by a surface of the pump housing. The seating surface and the corresponding surface of the valve may be of frustoconical or part-spherical form.

The invention has particular application in a common rail fuel pump of a compression-ignition internal combustion engine, but equally has use in other applications and particularly where high tensile stresses are induced within the pump components.

Unless indicated to the contrary, it will be appreciated that features described in relation to one aspect of the invention are also encompassed within any other aspect of the invention; and unless otherwise stated, features of embodiments may be combined with one another and such combinations are envisaged to fall within the scope of the invention.

Figure 2:
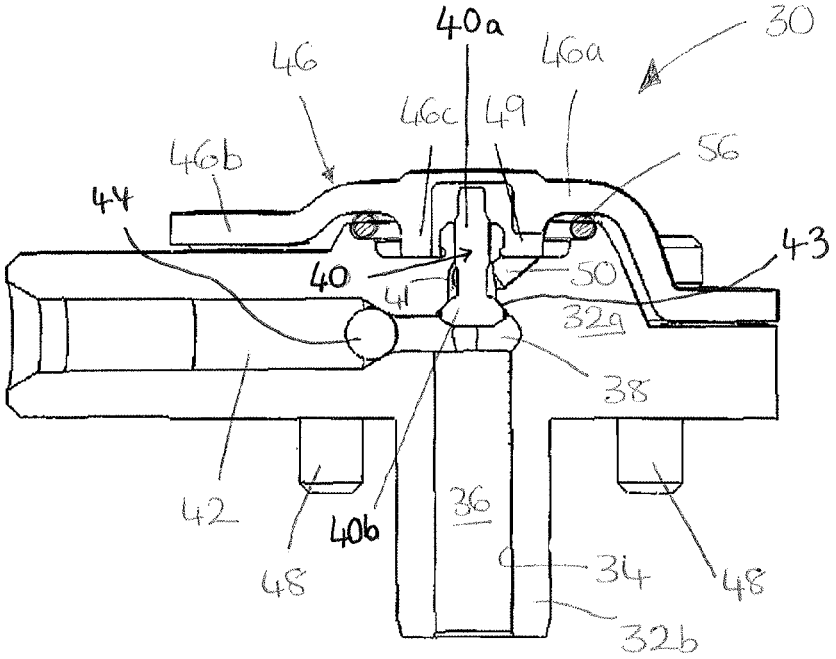
Figure 3:
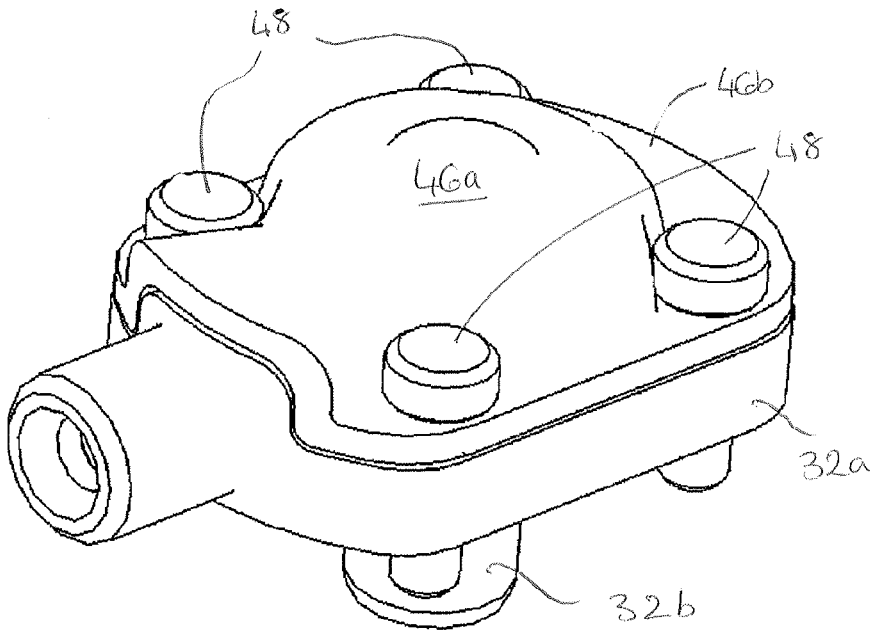
Figure 4:
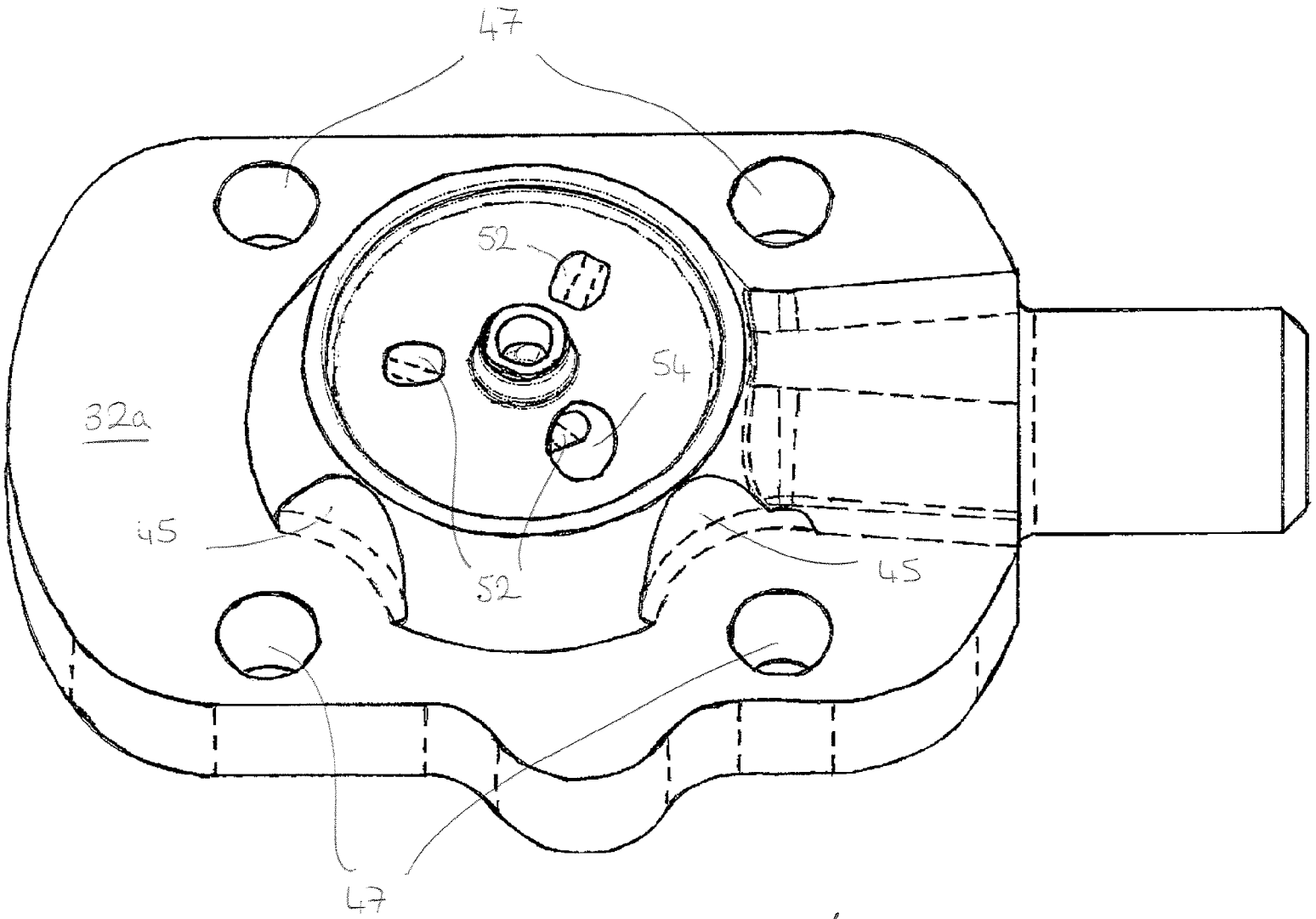
Figure 5:
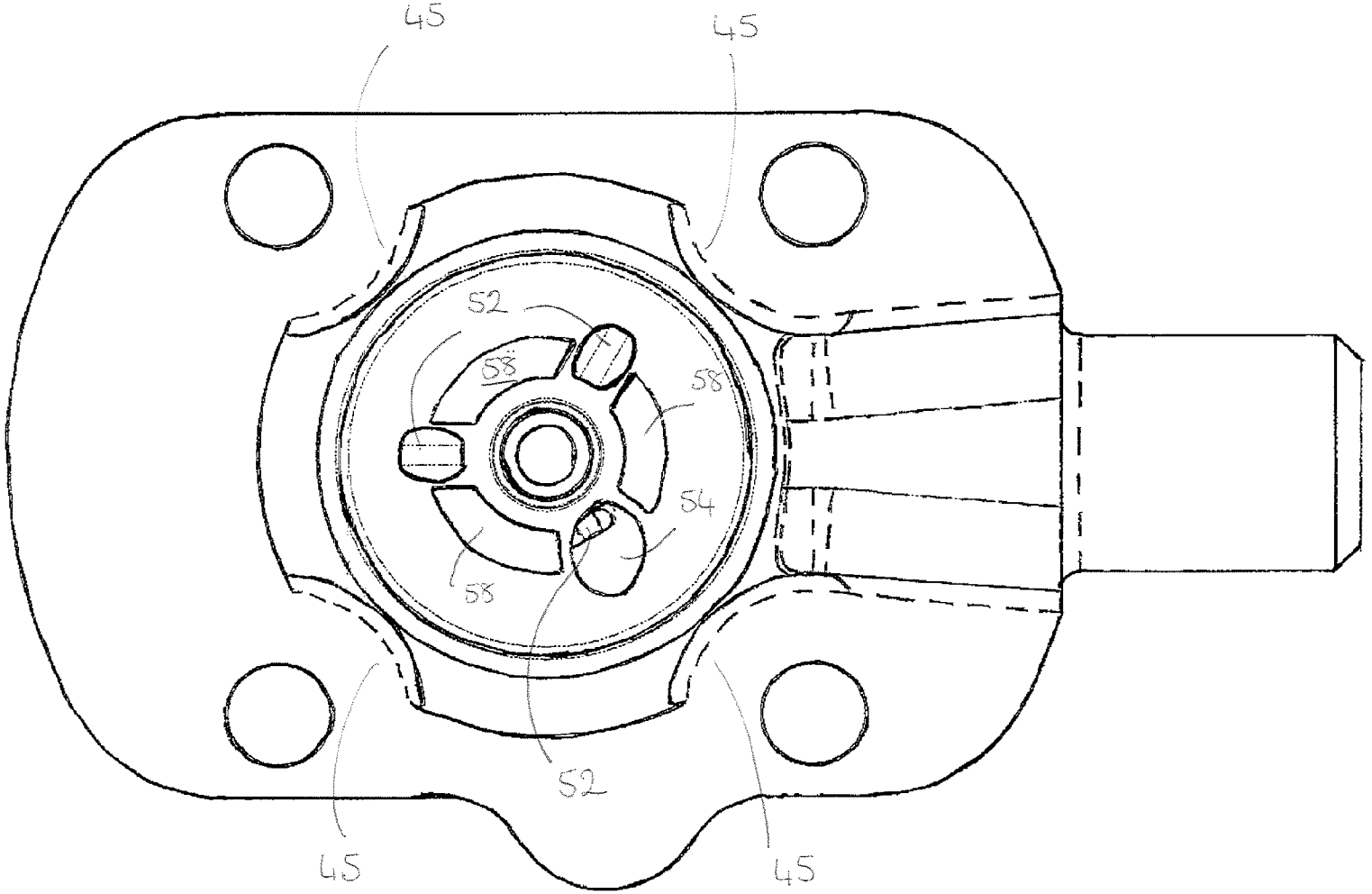

Preferred embodiments of the present invention will now be described, by way of example only, with reference to the accompanying drawings in which:

FIG. 2 is a section view of a pump assembly of one embodiment of the invention, including a pump housing, a pump chamber and a clamp member;

FIG. 3 is a perspective view of the clamp member of the pump assembly in FIG. 2;

FIG. 4 is a perspective view of the pump housing in FIG. 2, with the clamp member removed, to illustrate inlet ports for low pressure fuel; and FIG. 5 is a plan view of the external surface of the pump housing in FIG. 2 to illustrate where contact zones of the clamp member make contact with the pump housing.

DETAILED DESCRIPTION OF PREFERRED EMBODIMENTS

Referring to FIG. 2, a fuel pump assembly 30 of a first embodiment of the invention includes a pump housing having a head section 32*a* of enlarged diameter and a bore section 32*b* of reduced diameter which extends downwardly from the head section 32*a*. The bore section 32*b* of the pump housing is provided with a bore 34 within which a pumping plunger 36 is received. The bore 34 extends into a central portion of the head section 32*a* where it terminates in a pump chamber 38. The pump housing 32*a*, 32*b* is secured to a main pump housing (not shown), situated below the pump housing in the orientation shown in FIG. 2, so that the pump housing 32*a*, 32*b* effectively forms a head of the main pump housing.

The pumping plunger 36 is typically driven by means of an engine driven cam (not shown), or by any other suitable means as would be familiar to one skilled in the art. In use, as the plunger 36 is driven, it reciprocates within the plunger bore 34 along a plunger axis and causes fuel within the pump chamber 38 to be pressurised. The plunger 36 performs a pumping cycle having a filling stage of the cycle, during which fuel at relatively low level is delivered to the pump chamber 38, and a pumping stage during which fuel within the pump chamber 38 is pressurised to a relatively high level, typically in excess of 2000 bar.

The pump chamber 38 receives an inlet valve 40, 40*a*, 40*b* which is aligned axially with the plunger axis. The inlet valve includes a valve body 40*a* which extends through a valve bore 41 and a valve head 40*b* which engages with a valve seat 43 defined by the bore 34 at the intersection between the valve bore 41 and the pump chamber 38 so as to control the flow of fuel into the pump chamber 38. The valve head 40*b* is biased against the seat by means of a valve spring (not shown) and is caused to move away from the valve seat, against the spring force, during the filling stage. During the filling stage the plunger 36 is retracting from the bore 34 and low pressure fuel is delivered to the pump chamber 38.

Note that the valve head 40*b* seats against the valve seat 43 that is defined by the pump housing itself. This has advantages over alternative designs in which the valve member is provided in a separate valve block attached to the pump housing e.g. as exemplified in GB 2107801, since it avoids the requirement of a high pressure seal that may give rise to leakage problems. As depicted, the valve seat 43 is of frustoconical form for engagement with a corresponding frustoconical surface on the valve head 40*b*; however, part-spherical seating surfaces are also suitable. Conveniently, the inlet valve is a poppet-type valve, although other valves, such as ball valves, may alternatively be used. It will be noted that in the exemplified apparatus the inlet valve body 40*a* is only partially housed within the pump housing. In alternative arrangements, however, the entirety of the inlet valve may be housed within the pump housing.

The pump housing 32*a*, 32*b* is also provided with an outlet passage 42 which extends laterally from the pump chamber 38 through an outer portion of the head section 32*a* to supply pressurised fuel to a downstream common rail (not shown). The outlet passage 42 is provided with an outlet valve 44 which is biased closed by means of a valve spring (not shown). The outlet valve 44 is caused to open against the spring force during the pumping stage of the cycle to allow fuel that has been pressurised to a high level within the pump chamber 38 to be delivered through the outlet passage 42 to the common rail.

Referring also to FIGS. 3 and 4, a clamp member 46 is provided over the pump housing 32*a*, 32*b*. The clamp 46 is of generally top-hat construction, having a raised central section 46*a* and an outer skirt 46*b*. The skirt 46*b* seats against an upper surface of the outer portion of the head section 32*a* and is secured thereto by means of four bolts (only two of which, 48, are shown in FIG. 2) which extend through aligned pairs of receiving holes 47 (only visible in FIG. 4) in the skirt 46*b*, the outer peripheral region of the head section 32*a* and the main pump housing below.

In the embodiment depicted the central section 46*a* of the clamp includes a downwardly-extending portion 46*c* (only visible in FIG. 2) which engages with the upper surface of the central portion of the head section 32*a* via a plurality of contact zones, as will be described in further detail below. Guide features 45 are machined onto the head section 32*a* to aid the correct positioning of the clamp 46 on the pump housing, thereby ensuring the clamp 46 does not engage with the inlet valve spring.

The remainder of the lower surface of the clamp 46 is spaced from the upper surface of the head section 32*a* of the pump housing 32*a* to define an annular volume located radially outward of the downwardly-extending portion 46*c* of the clamp. The annular volume defines a filling chamber 49 for fuel from where fuel is delivered to the pump chamber 38 via a plurality of inlet passages (only one of which, 50, is shown in FIG. 2) provided in the head section 32*a* of the pump housing.

The inlet passages 50 extend obliquely from the valve bore 41 to emerge at ports 52 (shown in FIGS. 4 and 5) provided in the upper surface of the pump housing which communicate with the filling chamber 49. Typically, three inlet passages 50 are provided (although in practice a higher or lower number may be used) and are defined at equi-angularly spaced positions around the inlet valve 40*a*, 40*b*. However, may also be acceptable to space the inlet passages 50 at non-equal intervals.

Referring also to FIG. 5, a feed passage (not shown) is also provided in the pump housing, one end of which emerges at the upper surface of the head section 32*a* to define an additional port 54 into the filling chamber 49. The other end of the feed passage communicates with an upstream source of fuel at low pressure (e.g. a transfer pump). An O-ring seal 56 is located within the filling chamber 49 to prevent unwanted leakage of fuel from the chamber 49. It is notable that an O-ring seal may be acceptable since the chamber 49 only contains fuel at relatively low pressure; the high-pressure interfaces and seals being defined within the pump housing itself. This arrangement helps to avoid or at least reduce fuel leakage in the pump assembly.

The positions at which the ports 52, 54 emerge at the upper surface of the pump housing 32*a* determine the shape and location of the contact zones on the downwardly-extending portion 46*c* of the clamp 46. In the illustrated embodiment, the downwardly-extending portion 46*c* is essentially annular and defines three contact zones 58 of arc-formation which engage with correspondingly shaped regions of the pump housing 32*a* located approximately axially above the plunger bore 34 and at positions interspersed between the ports 52, 54.

In an alternative embodiment to that illustrated, if only two ports are provided in the upper surface of the housing, only two contact zones may need to be provided on the downwardly-extending portion of the clamp member. In a still further embodiment in which the filling chamber is located to one side of the pump chamber, rather than being axially above it, the downwardly-extending portion of the clamp member may define a single, uninterrupted zone of contact within the pump housing 32*a*. The uninterrupted contact zone is conveniently ring-shaped.

Upon assembly of the pump, the clamp 46 is initially placed over the upper surface of the head section 32*a* with the downwardly-extending portion 46*c* guided onto the head section 32*a* using the guide features 45 until it engages with the upper surface of the head section 32*a* via the contact zones 58. At this stage a clearance exists between the lower surface of the skirt 46*b* and the facing upper surface of the head section 32*a*. The bolts 48 are placed through their receiving holes 47 in the head section 32*a* and through the corresponding screw-threaded receiving holes in the main pump housing. As the bolts are tightened, the clamp 46 starts to deform elastically to close the clearance.

As the clamp 46 deforms, a clamping load is applied to the head section 32*a* of the pump housing through the contact zones 58 which engage with the upper surface of the head section above the plunger bore 34. The clamping load has at least a component which is axially aligned with the plunger axis and, consequently, an axial compressive stress is induced in the pump housing in that region beneath the contact zones 58. In other words, an axial compressive stress is generated in the head section 32*a* of the pump housing, in that region which is in the vicinity of, or in close proximity to, the pump chamber 38. Once the clearance has been closed, the contact force on the head section 32*a* remains substantially the same even if the bolts 48 are tightened further. Hence, the initial clearance between the clamp 46 and the head section 32*a* determines the axial compressive stress that is generated in the pump housing due to the tightening of the bolts.

Figure 1:
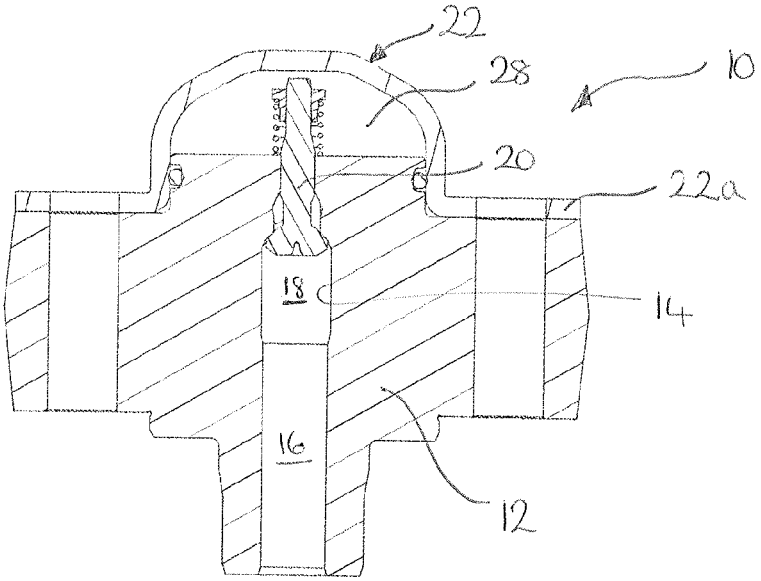
FIGURE 1 (PRIOR ART)
FIG. 1, which has already been described, shows a known pump assembly of a common rail fuel pump.

The axial compressive stress that is generated by the clamp 46 counters the axial tensile stress that is generated in the region of the pump housing in the vicinity of the plunger bore 34 due to the high pressures generated within the pump chamber 38. Typically, for example, fuel pressure within the pump chamber 38 is increased to a level in excess of 2000 bar for common rail applications, causing a high pulsating tensile stress to be induced within the pump housing 32*a*, 32*b*. The present invention differs from known pump arrangements, such as that shown in FIG. 1, where any clamping load is applied to the pump housing through the bolts 48, and so does not impact the most vulnerable region of the pump housing where tensile stress is greatest. The problems that result from axial tensile stresses within the pump housing, such as fatigue failure, are therefore substantially avoided by the present invention.

The clamp 46 may be formed from hardened and tempered steel (e.g. spring steel), typically having a yield stress of between 1000 and 1800 MPa, so that the clamp 46 deforms elastically as the bolts 48 are tightened to increase the clamping load. The clamp 46 therefore effectively acts as a spring as the bolts 48 are tightened. The greater the extent to which the clamp 46 is deformed, the greater the clamping load and the greater the induced compressive stress. Due to manufacturing tolerances, the clearance between the skirt 46*b* and the outer portion of the head section 32*a* may vary and so the clamping load (and hence the induced compressive stress) may vary slightly from one pump assembly to another.

Another embodiment of the invention (not shown) makes use of a spring located (e.g. sandwiched) between the clamp 46 and the head section 32*a* in the region approximately above the plunger bore 34 to provide the clamping load. This embodiment is, however, sensitive to variations in spring stiffness and spring length. The clearance between the clamp 46 and the pump housing 32*a*, 32*b* will vary slightly due to manufacturing tolerances and the length of the spring may also vary slightly from one pump assembly to another and so the spring force, and hence the clamping load, will vary slightly depending on the spring rate. The spring also adds to the overall size of the pump assembly, and so may not be a preferred embodiment for smaller-space applications.

In a still further embodiment, the clamp 46 may be formed from mild steel having a yield stress of between 200 and 600 MPa. In this case, the clamp 46 again deforms as the clearance between the skirt 46*a* and the outer portion of the head section 32*a* is closed as the bolts 48 are tightened. However, in this case the material properties of the clamp 46 are such that it reaches its elastic limit of deformation prior to the clearance closing and so deforms plastically for further tightening of the bolts 48. The point at which the clamp 46 reaches its elastic limit of deformation determines the clamping load that is applied to the pump housing through the contact zones 58. The use of mild steel may therefore be beneficial in that it avoids sensitivities due to the variations in the gap between the clamp 46 and the head section 32*a*. Mild steel also has the benefit that it is relatively low cost.

In pump assemblies in which the inlet valve 40*a*, 40*b* is not located axially above the pump chamber, but is to one side of the chamber (for example as described in EP 1629191 A1), the clamp may still be provided and may engage with the pump housing via a contact zone(s) that is axially aligned with the central axis of the plunger to achieve the same benefits as described previously.

It will be appreciated that the present invention has applications beyond common rail fuel pumps for diesel engines and may be used in other pump applications also, particularly where high pressures are generated within the pump chamber(s).

The invention claimed is:

1. A pump assembly for use in an internal combustion engine, the pump assembly comprising:

a pump housing provided with a bore within which a pumping plunger is reciprocal along a plunger axis which is axially centered about the pumping plunger, a pump chamber defined at one end of the bore within which fuel is pressurised to a relatively high level as the pumping plunger reciprocates within the bore, in use, and an inlet valve housed within the pump housing and in communication with the pump chamber to control the flow of fuel into the pump chamber;

a clamp member for applying a clamping load to the pump housing, the clamping load having at least a component aligned with the plunger axis, directly from the clamp member on a surface of the pump housing located directly above the bore; and at least one securing member for securing the clamp member to the pump housing, wherein the at least one securing member is positioned radially outward from the bore and extends through or below a plane such that the plane is through the pump chamber and perpendicular to the plunger axis.

2. The pump assembly according to claim 1, wherein the inlet valve comprises a valve body and a valve head and wherein a surface of the pump housing defines an inlet valve seat for sealing engagement with a surface of the valve head in order to prevent fuel flow into the pumping chamber when the valve head is engaged with the inlet valve seat while allowing fuel flow into the pumping chamber when the valve head is not engaged with the inlet valve seat.

3. The pump assembly according to claim 2, wherein the inlet valve seat is of frustoconical or part-spherical form for cooperation with a frustoconical or part-spherical surface of the valve head.

4. The pump assembly according to claim 1, wherein the pump housing includes a bore section within which the plunger bore is provided and wherein the clamp member is arranged to apply the clamping load to the surface of the pump housing located axially above the bore section.

5. The pump assembly according to claim 4, wherein the pump housing includes a head section and the plunger bore extends into the head section of the pump housing so that the pump chamber is defined, at least in part, within the head section.

6. The pump assembly according to claim 1, wherein a surface of the pump housing and an internal surface of the clamp member together define a filling chamber for receiving low pressure fuel from where fuel is delivered to the pump chamber.

7. The pump assembly according to claim 1, wherein the clamp member has at least one primary contact surface that engages the pump housing approximately axially above the bore, and at least one secondary contact surface that engages the pump housing radially outward from the bore.

8. The pump assembly according to claim 7, wherein each primary contact surface is defined on a projection of the clamp member.

9. The pump assembly according to claim 7, wherein the at least one primary contact surface comprises at least one contact zone having an arc formation such that the that least one primary contact surface directly engages the housing.

10. A pump assembly for use in an internal combustion engine, the pump assembly comprising:

a pump housing provided with a bore within which a pumping plunger is reciprocal along a plunger axis which is axially centered about the pumping plunger;

a pump chamber defined at one end of the bore within which fuel is pressurised to a relatively high level as the pumping plunger reciprocates within the bore; and a clamp member for applying a clamping load to the pump housing, the clamping load having at least a component that is aligned with the plunger axis, directly from the clamp member on a surface of the pump housing located directly above the bore so as to generate a compressive stress in the pump housing in close proximity to the plunger bore to counter tensile stress within the pump housing due to pressurised fuel within the pump chamber;

wherein the clamp member is formed from a material that deforms as the clamping load is applied to the pump housing.

11. The pump assembly according to claim 10, wherein the clamp member is formed from a material that deforms elastically as the clamping load is applied to the pump housing.

12. The pump assembly according to claim 10, wherein the clamp member is formed from a material that deforms plastically as the clamping load is applied to the pump housing.

13. The pump assembly according to claim 10, further comprising an inlet valve housed within the pump housing and in communication with the pump chamber to control the flow of fuel into the pump chamber; and an outlet valve housed within the pump housing and in communication with the pump chamber to modulate the delivery of fuel from the pump chamber to an outlet passage.

14. The pump assembly according to claim 1, which further comprises an outlet valve housed within the pump housing and in communication with the pump chamber to modulate the delivery of fuel from the pump chamber to an outlet passage.

15. The pump assembly according to claim 1, wherein the clamp member is formed from a material that deforms elastically as the clamping load is applied to the pump housing.

16. The pump assembly according to claim 1, wherein the clamp member is formed from a material that deforms plastically as the clamping load is applied to the pump housing.

17. The pump assembly according to claim 1, wherein the at least one securing member extends through the clamp member and the pump housing to secure the clamp member to the pump housing at an outer peripheral region of the pump housing.

18. The pump assembly according to claim 1, wherein the clamp member is of generally top-hat shaped construction, having a raised central portion and an outer skirt.

19. The pump assembly according to claim 1, wherein the inlet valve is aligned axially with the plunger axis.

* * * * *